US010019960B2

(12) United States Patent
Su

(10) Patent No.: US 10,019,960 B2
(45) Date of Patent: Jul. 10, 2018

(54) METHOD AND APPARATUS FOR DETERMINING DRIVING VOLTAGES

(71) Applicants: BEIJING BOE DISPLAY TECHNOLOGY CO., LTD., Beijing (CN); BOE TECHNOLOGY GROUP CO., LTD., Beijing (CN)

(72) Inventor: Dan Su, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 537 days.

(21) Appl. No.: 14/235,607

(22) PCT Filed: Aug. 5, 2013

(86) PCT No.: PCT/CN2013/080850
§ 371 (c)(1),
(2) Date: Jan. 28, 2014

(87) PCT Pub. No.: WO2014/190615
PCT Pub. Date: Dec. 4, 2014

(65) Prior Publication Data

US 2016/0071475 A1 Mar. 10, 2016

(30) Foreign Application Priority Data

May 31, 2013 (CN) ..... 2013 1 0214465

(51) Int. Cl.
*G09G 3/36* (2006.01)

(52) U.S. Cl.
CPC ... *G09G 3/3696* (2013.01); *G09G 2320/0204* (2013.01); *G09G 2320/0257* (2013.01);
(Continued)

(58) Field of Classification Search
CPC ..... G09G 3/36; G09G 3/3607; G09G 3/3696
(Continued)

(56) References Cited

U.S. PATENT DOCUMENTS

2002/0126076 A1* 9/2002 Itakura ..... G09G 3/2011 345/87
2005/0062704 A1 3/2005 Whittington et al.
(Continued)

FOREIGN PATENT DOCUMENTS

CN 102110421 A 6/2011
CN 102708821 A 10/2012
TW I275065 B 3/2007

OTHER PUBLICATIONS

International Preliminary Report on Patentability Appln. No. PCT/CN2013/080850; dated Dec. 1, 2015.
(Continued)

*Primary Examiner* — David Tung
(74) *Attorney, Agent, or Firm* — Ladas & Parry LLP

(57) ABSTRACT

Provided are a method and apparatus for determining driving voltages, when a high driving voltage and a low driving voltage of a TFT-LCD are set for each gray scale, an average of the high driving voltage and the low driving voltage of the gray scale are determined at first according to a voltage jump of a pixel electrode in the TFT-LCD for the gray scale, and then the high driving voltage and the low driving voltage of the TFT-LCD are set according to the average, a relationship curve between driving voltages of a source driving integrated circuit and light transmittances of the TFT-LCD, and a Gamma curve of the TFT-LCD. Because the average of the high driving voltage and the low driving voltage are determined according to the voltage jump of the pixel electrode in the TFT-LCD, a phenomenon of asymmetry in the driving voltages caused when the voltage jump of the pixel electrode is different from a difference between the average of the high
(Continued)

driving voltage and the low driving voltage and a reference voltage Vcom of the TFT-LCD would not occur, so that a image sticking problem due to a shift of the voltage jump of the pixel electrode in the TFT-LCD is avoided.

16 Claims, 8 Drawing Sheets

(52) U.S. Cl.
CPC ..... *G09G 2320/0276* (2013.01); *G09G 2320/0673* (2013.01)

(58) Field of Classification Search
USPC ..... 345/87–103, 204–699
See application file for complete search history.

(56) References Cited

U.S. PATENT DOCUMENTS

2005/0200619 A1* 9/2005 Adachi ..... G09G 3/2025 345/204
2006/0187160 A1 8/2006 Lai

OTHER PUBLICATIONS

International Search Report dated Mar. 13, 2014; PCT/CN2013/080850.
English abstract of CN102708821A, listed above, 1 page.
First Office Action (Chinese language) issued by the State Intellectual Property Office ("SIPO") dated Oct. 10, 2014 for International Application No. 201310214465.2, 6 pages.
English translation of first Office Action issued by SIPO (listed above) for International Application No. 2013102144651, 7 pages.

* cited by examiner

| G/L | r2.2 |
|---|---|
| L0 | 0.00000% |
| L1 | 0.01100% |
| L16 | 4.90360% |
| L32 | 22.53101% |
| L48 | 54.97706% |
| L62 | 96.54116% |
| L63 | 100.00000% |

Fig.8

| Gray scale level | Gamma voltage | |
|---|---|---|
| L0 | V1 | V14 |
| L1 | V2 | V13 |
| L16 | V3 | V12 |
| L32 | V4 | V11 |
| L48 | V5 | V10 |
| L62 | V6 | V9 |
| L63 | V7 | V8 |

Fig.9

METHOD AND APPARATUS FOR DETERMINING DRIVING VOLTAGES

CROSS REFERENCE TO RELATED APPLICATIONS

This application is based on International Application No., PCT/CN2013/080850 filed on Aug. 5, 2013, which claims priority to Chinese National Application No. 201310214465.2 filed on May 31, 2013, the contents of which are incorporated herein by reference.

TECHNICAL FIELD

The present disclosure relates to a field of liquid crystal display technology, and particularly to a method and an apparatus for determining driving voltages.

BACKGROUND

Image sticking is considered as one of serious problems in manufacture process of a Thin Film Transistor-Liquid Crystal Display (TFT-LCD). The image sticking can be classified into Direct Current (DC) image sticking and Alternating Current (AC) image sticking. Generally, the DC image sticking is regarded as an image sticking caused in the following manner: mental particles and non-mental particles originally being in a free state in a liquid crystal layer run to one side of an electric field due to asymmetry of driving voltages of the TFT-LCD, and then fail to return to the free state when no voltage is applied, and thus differences in brightness of the TFT-LCD may be caused, resulting in the image sticking.

The driving voltages of TFT-LCD for respective gray scales comprise a high driving voltage and a low driving voltage, and the driving voltages of the TFT-LCD are determined generally according to a relationship curve between driving voltages of a source driving integrated circuit and light transmittances of the TFT-LCD as shown in FIG. 1 and a Gamma curve of the source driving integrated circuit as shown in FIG. 2. Wherein, the source driving integrated circuit is a circuit for driving a display module of the TFT-LCD. The Gamma curve is a curve reflecting a relationship between the light transmittances of the TFT-LCD and the gray scales, and may be determined according to a Gamma value of the TFT-LCD. Each TFT-LCD has a fixed Gamma value usually, and the Gamma value is a specified value leading to a distortion to an input image by the TFT-LCD. If the Gamma value of the TFT-LCD is 2.5, given a light brightness of 0.5 for a pixel, the light brightness output on a display is only 0.2 (that is, 0.5/2.5) in a case that no color management application is performed. Different Gamma values correspond to different Gamma curves, and in the curve shown in FIG. 1, horizontal ordinates represent the driving voltages of the source driving integrated circuit, and vertical ordinates represent the light transmittances of the TFT-LCD; in the Gamma curve shown in FIG. 2, horizontal ordinates represent gray scale levels, and vertical ordinates represent the light transmittances of the TFT-LCD. Change in the driving voltage may lead to change in the gray scales of the TFT-LCD, and in turn the change in the gray scales may lead to change in the light transmittance of the TFT-LCD. Therefore the driving voltage corresponding to each gray scale may be determined by a manner that the correspondence between the gray scales and the light transmittances of the TFT-LCD is determined at first, and then the correspondence between the light transmittances of the TFT-LCD and the driving voltages is determined. Such method for determining the driving voltages is embodied as: the light transmittance of the TFT-LCD for each of the respective gray scales in the Gamma curve of the TFT-LCD is determined at first, then the larger one of two voltages, which correspond to the light transmittance of the TFT-LCD for the gray scale, on the relationship curve between the driving voltages of the source driving integrated circuit and the light transmittances of the TFT-LCD is the high driving voltage of the gray scale, and the smaller one is the low driving voltage of the gray scale. Generally, in the source driving integrated circuit, a voltage jump may appear at a pixel electrode due to a coupling capacitor between a gate and a source of TFT at a moment when a gate signal becomes off from on, and a difference of the voltages at the pixel electrode before and after such jump is referred to as a voltage jump. There is also a reference voltage Vcom in the source driving integrated circuit of the TFT-LCD, and a voltage difference between the reference voltage Vcom and the driving voltages may cause a difference in an angle of deflection of the liquid crystal molecules, such that the light transmittances are different. The reference voltage Vcom may be determined according to the driving voltages as the gray scale is 0. During display, the driving voltages of the TFT-LCD would be symmetrical if the voltage jump of the pixel electrode for each gray scale is the difference between an average of the high driving voltage and the low driving voltage of the gray scale and the reference voltage Vcom. However, the voltage jump of the pixel electrode is often different from the difference between the average of the high driving voltage and the low driving voltage of the gray scale and the reference voltage Vcom in an actual circuit, such that the driving voltages of the TFT-LCD are asymmetrical in an actual usage and the image sticking would occur.

SUMMARY

In embodiments of the present disclosure, there is provided a method and an apparatus for determining driving voltages, in order to settle a problem of image sticking occurred in the liquid crystal display.

According to an embodiment of the present disclosure, there is provided a method for determining driving voltages, comprising: determining, for each gray scale, an average of a high driving voltage and a low driving voltage of the gray scale, according to a voltage jump of a pixel electrode in the TFT-LCD for the gray scale; and setting the high driving voltage and the low driving voltage of the gray scale, according to the average of the high driving voltage and the low driving voltage for the gray scale, a relationship curve between driving voltages of a source driving integrated circuit and light transmittances of the TFT-LCD, and a Gamma curve of the TFT-LCD.

According to another embodiment of the present disclosure, there is provided an apparatus for determining driving voltages, comprising: a first determining unit, for determining, for each gray scale, an average of a high driving voltage and a low driving voltage of the gray scale, according to a voltage jump of a pixel electrode in the TFT-LCD for the gray scale; and a setting unit for setting the high driving voltage and the low driving voltage of the gray scale, according to the average of the high driving voltage and the low driving voltage for the gray scale, a relationship curve between driving voltages of a source driving integrated circuit and light transmittances of the TFT-LCD, and a Gamma curve of the TFT-LCD.

In the method and apparatus for determining driving voltages provided in the embodiments of the present disclosure, when the high driving voltage and the low driving voltage of the TFT-LCD are set, for each gray scale, the average of the high driving voltage and the low driving voltage of the gray scale are determined at first according to the voltage jump of the pixel electrode in the TFT-LCD for the gray scale, and then the high driving voltage and the low driving voltage of the gray scale are set according to the average of the high driving voltage and the low driving voltage for the gray scale, a relationship curve between driving voltages of a source driving integrated circuit and light transmittances of the TFT-LCD, and a Gamma curve of the TFT-LCD. Because the average of the high driving voltage and the low driving voltage are determined according to the voltage jump of the pixel electrode in the TFT-LCD, the phenomenon of asymmetry in the driving voltages caused when the voltage jump of the pixel electrode is different from the difference between the average of the high driving voltage and the low driving voltage and the reference voltage Vcom of the TFT-LCD would not occur, so that the image sticking problem due to a shift of the voltage jump of the pixel electrode in the TFT-LCD is avoided.

BRIEF DESCRIPTION OF THE DRAWINGS

FIG. 8 is a table illustrating the transmittances of the respective gray scales according to the embodiments of the present disclosure;

FIG. 9 is a table illustrating the high driving voltages and the low driving voltages for the respective gray scales according to the embodiments of the present disclosure;

DETAILED DESCRIPTION

In a method and apparatus for determining driving voltages provided in embodiments of the present disclosure, when a high driving voltage and a low driving voltage of a TFT-LCD are set, for each gray scale, an average of the high driving voltage and the low driving voltage of the gray scale are determined at first according to a voltage jump of a pixel electrode in the TFT-LCD for the gray scale, and then the high driving voltage and the low driving voltage of the gray scale are set according to the average of the high driving voltage and the low driving voltage for the gray scale, a relationship curve between driving voltages of a source driving integrated circuit and light transmittances of the TFT-LCD, and a Gamma curve of the TFT-LCD. Because the average of the high driving voltage and the low driving voltage are determined according to the voltage jump of the pixel electrode in the TFT-LCD, the phenomenon of asymmetry in the driving voltages caused when the voltage jump of the pixel electrode is different from a difference between the average of the high driving voltage and the low driving voltage and a reference voltage Vcom of the TFT-LCD would not occur, so that the image sticking problem due to a shift of the voltage jump of the pixel electrode in the TFT-LCD is avoided.

Figure 3:
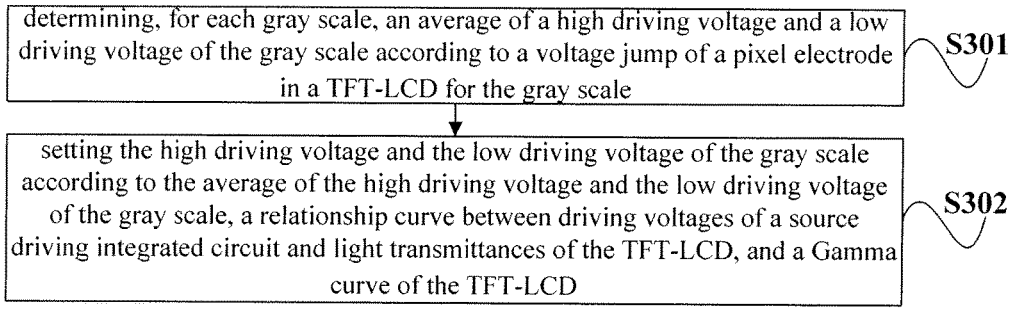
FIG. 3 is a flowchart illustrating a method for determining driving voltages according to embodiments of the present disclosure.

FIG. 3 is a flowchart illustrating a method for determining driving voltages according to embodiments of the present disclosure.

At step S301, for each gray scale, an average of a high driving voltage and a low driving voltage of the gray scale is determined according to a voltage jump of a pixel electrode in a TFT-LCD for the gray scale.

At step S302, the high driving voltage and the low driving voltage of the gray scale are set according to the average of the high driving voltage and the low driving voltage of the gray scale, a relationship curve between driving voltages of a source driving integrated circuit and light transmittances of the TFT-LCD, and a Gamma curve of the TFT-LCD.

The phenomenon of asymmetry in the driving voltages would occur if the voltage jump of the pixel electrode in the TFT-LCD is different from a difference between the average of the high driving voltage and the low driving voltage of the gray scale and a reference voltage Vcom of the TFT-LCD, therefore in the embodiments of the present disclosure, when the high driving voltage and the low driving voltage of the TFT-LCD are set, for each gray scale, the average of the high driving voltage and the low driving voltage of the gray scale is determined at first according to the voltage jump of the pixel electrode in the TFT-LCD for the gray scale, and then the high driving voltage and the low driving voltage of the gray scale are set according to the determined average of the high driving voltage and the low driving voltage for the gray scale, the relationship curve between the driving voltages of the source driving integrated circuit and the light transmittances of the TFT-LCD, and the Gamma curve of the TFT-LCD. So that the phenomenon of asymmetry in the driving voltages caused when the voltage jump of the pixel electrode in the TFT-LCD is different from a difference between the average of the high driving voltage and the low driving voltage of the gray scale and the reference voltage Vcom of the TFT-LCD is avoided, and the image sticking is thus avoided.

At step S301, the process of determining the average of the high driving voltage and the low driving voltage of the gray scale according to the voltage jump of the pixel electrode in the TFT-LCD for the gray scale may be implemented as follows.

The average of the high driving voltage and the low driving voltage of the gray scale is determined as Vcenter=Vcom+ΔVp, wherein, ΔVp is the voltage jump of the pixel electrode in the TFT-LCD for the gray scale, and Vcom=V0/2−ΔVp0, wherein V0 is a sum of the high driving voltage and the low driving voltage, which corresponds to the light transmittance of the TFT-LCD corresponding to a gray scale 0 in the Gamma curve of the TFT-LCD, in the relationship curve between the driving voltages of the source driving integrated circuit and the light transmittances of the TFT-LCD, and ΔVp0 is the voltage jump of the pixel electrode in the TFT-LCD corresponding to the gray scale 0.

In particular, the voltage jump ΔVp of the pixel electrode in the TFT-LCD for the gray scale may be determined by ΔVp=ΔVpmax−(1−i/n)Ω, wherein i is a gray scale level of the gray scale, n is a total number of the gray scales, ΔVpmax is a maximum value of $$\Delta Vp = \frac{C_{gd}(V_{on} - V_{off})}{C_{gd} + C_s + C_{lc}},$$

Ω is a difference between the maximum value and a minimum value of $$\Delta Vp = \frac{C_{gd}(V_{on} - V_{off})}{C_{gd} + C_s + C_{lc}},$$

$V_{on}$ is an ON voltage in the TFT-LCD, $V_{off}$ is an OFF voltage in the TFT-LCD, $C_{gd}$ is a parasitic capacitor between a drain and a gate in the TFT-LCD, $C_s$ is a pixel storage capacitor in the TFT-LCD, and $C_{lc}$ is a material equivalent capacitor in the TFT-LCD.

Figure 4:
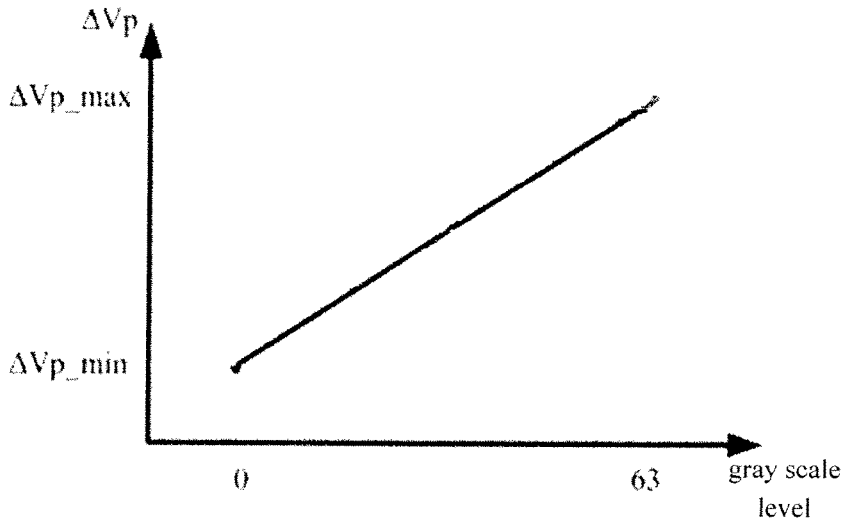
FIG. 4 illustrates a linear trend of a relationship curve between voltage jumps of pixel electrodes in the TFT-LCD and the gray scales according to the embodiments of the present disclosure.

Taking a case where the total number of the gray scales is 63 as an example, the voltage jump of the pixel electrode in the TFT-LCD is ΔVp=ΔVpmax−(1−i/63)Ω. The maximum value of ΔVp is the maximum value of $$\Delta Vp = \frac{C_{gd}(V_{on} - V_{off})}{C_{gd} + C_s + C_{lc}},$$

and ΔVp is generally large for a high gray scale, therefore the maximum value of $$\Delta Vp = \frac{C_{gd}(V_{on} - V_{off})}{C_{gd} + C_s + C_{lc}}$$

is the ΔVp when the gray scale is highest. The minimum value of the ΔVp is the minimum value of $$\Delta Vp = \frac{C_{gd}(V_{on} - V_{off})}{C_{gd} + C_s + C_{lc}},$$

and the ΔVp is generally small for a low gray scale, therefore the minimum value of $$\Delta Vp = \frac{C_{gd}(V_{on} - V_{off})}{C_{gd} + C_s + C_{lc}}$$

is the ΔVp when the gray scale is lowest. The maximum value and the minimum value of the $$\Delta Vp = \frac{C_{gd}(V_{on} - V_{off})}{C_{gd} + C_s + C_{lc}}$$

may be determined by adjusting capacitances. Next, a linear trend of the relationship curve between the voltage jumps of the pixel electrode in the TFT-LCD and the gray scales may be determined according to the ΔVp corresponding to the highest gray scale and the ΔVp corresponding to the lowest gray scale, as illustrated in FIG. 4. The voltage jumps of the pixel electrode in the TFT-LCD for the respective gray scales may be determined according to ΔVp=ΔVpmax−(1−i/n)Ω, for example: when i is 0, its voltage jump of the pixel electrode in the TFT-LCD may be determined according to ΔVp=ΔVpmin, wherein ΔVpmin is the minimum value of $$\Delta Vp = \frac{C_{gd}(V_{on} - V_{off})}{C_{gd} + C_s + C_{lc}};$$

when i is 1, its voltage jump of the pixel electrode in the TFT-LCD may be determined by ΔVp=ΔVpmax-0.984Ω; when i is 16, its voltage jump of the pixel electrode in the TFT-LCD may be determined by ΔVp=ΔVpmax-0.746Ω; when i is 32, its voltage jump of the pixel electrode in the TFT-LCD may be determined by ΔVp=ΔVpmax−0.492Ω; when i is 48, its voltage jump of the pixel electrode in the TFT-LCD may be determined by ΔVp=ΔVpmax−0.238Ω; when i is 62, its voltage jump of the pixel electrode in the TFT-LCD may be determined by ΔVp=ΔVpmax−0.016Ω; when i is 63, its voltage jump of the pixel electrode in the TFT-LCD may be determined by ΔVp=ΔVpmax.

The average of the high driving voltage and the low driving voltage of the gray scale is set as Vcenter=Vcom+ΔVp, therefore the voltage jump of the pixel electrode may be ensured effectively to be same as the difference between the average of the high driving voltage and the low driving voltage of the gray scale and the reference voltage Vcom of the TFT-LCD, so that the phenomenon of asymmetry in the driving voltages is avoided effectively, and in turn occurrence of the image sticking are also avoided.

Of course, those skilled in the art may set the average of the high driving voltage and the low driving voltage of the gray scale with other suitable manners, the embodiment described herein is only an exemplary manner, and other implementations are omitted herein.

Figure 5:
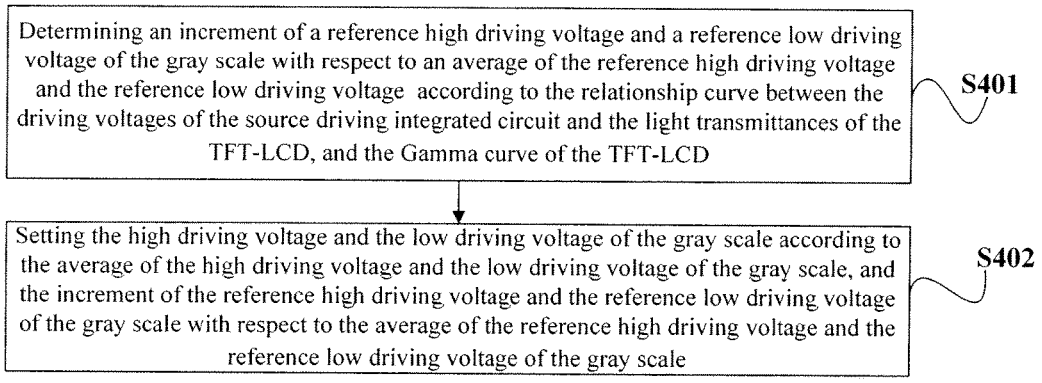
FIG. 5 is a flowchart illustrating a method for setting a high driving voltage and a low driving voltage according to the embodiments of the present disclosure.

In practice, as illustrated in FIG. 5, the process of setting the high driving voltage and the low driving voltage of the gray scale according to the average of the high driving voltage and the low driving voltage of the gray scale, the relationship curve between driving voltages of the source driving integrated circuit and light transmittances of the TFT-LCD, and the Gamma curve of the TFT-LCD in S302 may comprise the following steps.

At a step S401, an increment of a reference high driving voltage and a reference low driving voltage of the gray scale with respect to an average of the reference high driving voltage and the reference low driving voltage is determined according to the relationship curve between the driving voltages of the source driving integrated circuit and the light transmittances of the TFT-LCD, and the Gamma curve of the TFT-LCD, wherein the reference high driving voltage and the reference low driving voltage of the gray scale are a high driving voltage and a low driving voltage, which correspond to the light transmittance of the TFT-LCD corresponding to the gray scale, on the relationship curve between the driving voltages of the source driving integrated circuit and the light transmittances of the TFT-LCD, respectively.

At a step S402, the high driving voltage and the low driving voltage of the gray scale are set according to the average of the high driving voltage and the low driving voltage of the gray scale, and the increment of the reference high driving voltage and the reference low driving voltage of the gray scale with respect to the average of the reference high driving voltage and the reference low driving voltage of the gray scale.

Since the Gamma curve of the TFT-LCD may show the light transmittances corresponding to the respective gray scales when the TFT-LCD has a best display effect, the increment of the reference high driving voltage and the reference low driving voltage of the gray scale with respect to the average of the reference high driving voltage and the reference low driving voltage of the gray scale may be determined according to the relationship curve between the driving voltages of the source driving integrated circuit and the light transmittances of the TFT-LCD, and the Gamma curve of the TFT-LCD, after the average of the high driving voltage and the low driving voltage is determined; and then the high driving voltage and the low driving voltage may be set according to the average of the high driving voltage and the low driving voltage of the gray scale, and the increment of the reference high driving voltage and the reference low driving voltage of the gray scale with respect to the average of the reference high driving voltage and the reference low driving voltage of the gray scale. Thus the display effect of the TFT-LCD is ensured while the occurrence of the image sticking is avoided.

Of course, those skilled in the art may utilize other suitable manners to set the high driving voltage and the low driving voltage of the gray scale according to the average of the high driving voltage and the low driving voltage of the gray scale, the relationship curve between the driving voltages of the source driving integrated circuit and the light transmittances of the TFT-LCD, and the Gamma curve of the TFT-LCD. The embodiment described herein is only a preferred implementation, and other implementations are omitted herein.

Figure 6:
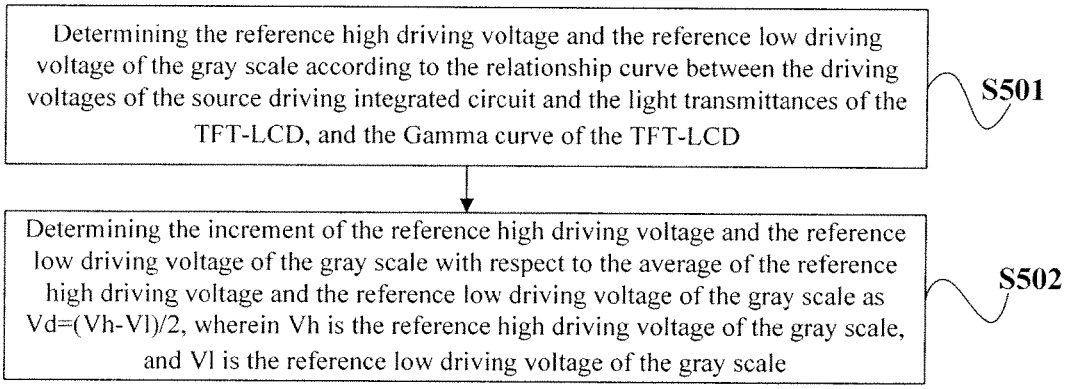
FIG. 6 is a flowchart illustrating a method for determining an increment according to the embodiments of the present disclosure.

In an example, as illustrated in FIG. 6, the process of determining the increment of the reference high driving voltage and the reference low driving voltage of the gray scale with respect to the average of the reference high driving voltage and the reference low driving voltage of the gray scale according to the relationship curve between the driving voltages of the source driving integrated circuit and the light transmittances of the TFT-LCD and the Gamma curve of the TFT-LCD at the step 401 may be implemented as follows.

At a step S501, the reference high driving voltage and the reference low driving voltage of the gray scale are determined according to the relationship curve between the driving voltages of the source driving integrated circuit and the light transmittances of the TFT-LCD, and the Gamma curve of the TFT-LCD;

At a step S502, the increment of the reference high driving voltage and the reference low driving voltage of the gray scale with respect to the average of the reference high driving voltage and the reference low driving voltage of the gray scale is determined as $Vd=(Vh-Vl)/2$, wherein Vh is the reference high driving voltage of the gray scale, and Vl is the reference low driving voltage of the gray scale.

Of course, those skilled in the art may utilize other suitable manners to determine the increment of the reference high driving voltage and the reference low driving voltage of the gray scale with respect to the average of the reference high driving voltage and the reference low driving voltage of the gray scale according to the relationship curve between the driving voltages of the source driving integrated circuit and the light transmittances of the TFT-LCD, and the Gamma curve of the TFT-LCD. The embodiment described herein is only a preferred implementation, and other implementations are omitted herein.

Figure 7:
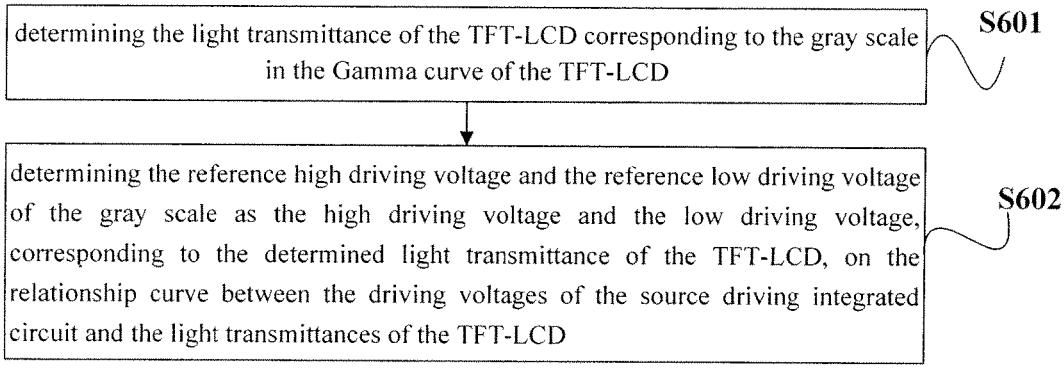
FIG. 7 is a flowchart illustrating a method for determining a reference high driving voltage and a reference low driving voltage according to the embodiments of the present disclosure.

In an example, as illustrated in FIG. 7, the process of determining the reference high driving voltage and the reference low driving voltage of the gray scale according to the relationship curve between the driving voltages of the source driving integrated circuit and the light transmittances of the TFT-LCD, and the Gamma curve of the TFT-LCD at the step 501 may particularly include the following steps.

At a step S601, the light transmittance of the TFT-LCD corresponding to the gray scale is determined in the Gamma curve of the TFT-LCD.

At a step S602, the reference high driving voltage and the reference low driving voltage of the gray scale are determined as a high driving voltage and a low driving voltage, corresponding to the determined light transmittance of the TFT-LCD, in the relationship curve between the driving voltages of the source driving integrated circuit and the light transmittances of the TFT-LCD.

Figure 1:
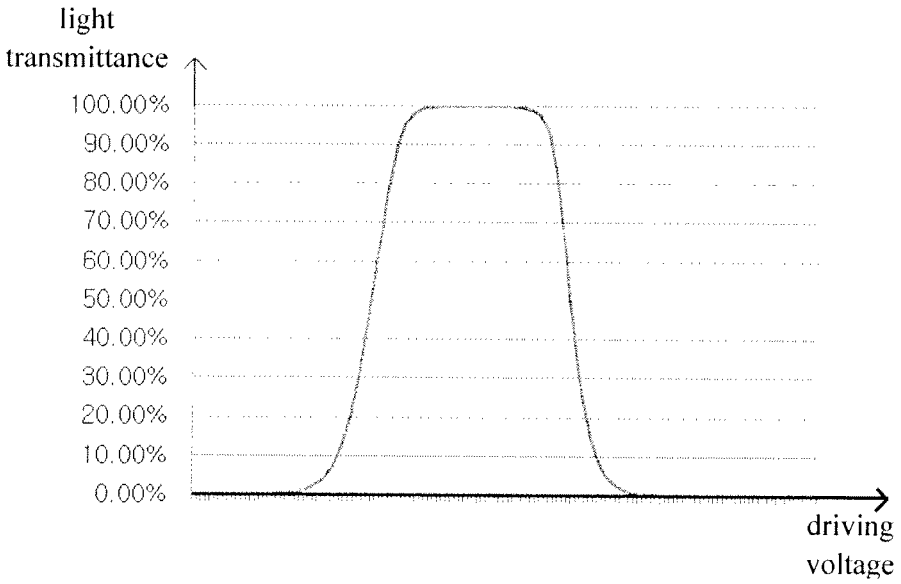
FIG. 1 is a schematic diagram illustrating a relationship curve between driving voltages in a source driving integrated circuit and light transmittances of a TFT-LCD provided in the prior art.
Figure 2:
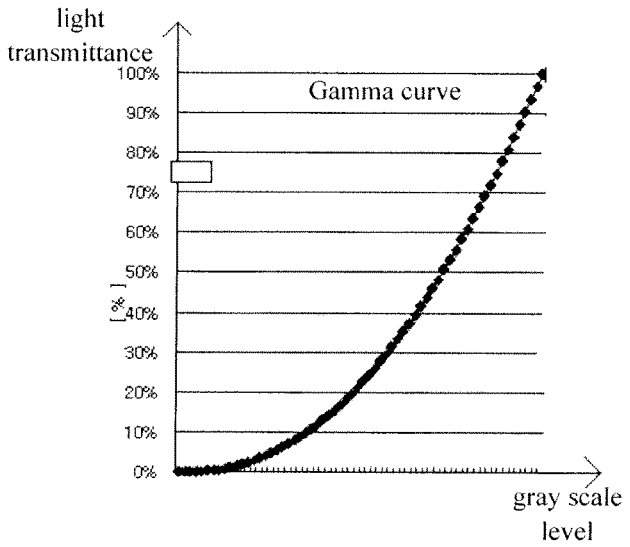
FIG. 2 is a schematic diagram illustrating a Gamma curve of a TFT-LCD provided in the prior art.

In particular, the light transmittances of the respective gray scales may be determined at first according to the Gamma curve of the TFT-LCD illustrated in FIG. 2, wherein the Gamma curve shown in FIG. 2 is a Gamma curve with a Gamma value of 2.2, the horizontal ordinates in the Gamma curve shown in FIG. 2 represent the gray scale levels, and the vertical ordinates represent the light transmittances of the TFT-LCD. In practice, the Gamma curve of FIG. 2 may be determined according to the Gamma value of the TFT-LCD, and the Gamma curve of FIG. 2 is a Gamma curve corresponding to the Gamma value of 2.2 when the Gamma value of the TFT-LCD is 2.2. The determined light transmittances of the TFT-LCD corresponding to the respective gray scales are illustrated in a table in FIG. 8, the high driving voltages and the low driving voltages corresponding to the light transmittances of the TFT-LCD for the respective gray scales may be found in the relationship curve between the driving voltages of the source driving integrated circuit and the light transmittances of the TFT-LCD illustrated in FIG. 1, according to the light transmittances of the TFT-LCD corresponding to the respective gray scales. In the curve shown in FIG. 1, the horizontal ordinates represent the driving voltages of the source driving integrated circuit, and the vertical ordinates represent the light transmittances of the TFT-LCD, then the greater one of the two voltages corresponding to the light transmittance of a gray scale in the relationship curve between the driving voltages of the source driving integrated circuit and the light transmittances of the TFT-LCD is the high driving voltage of the gray scale, and the smaller one is the low driving voltage of the gray scale. The determined high driving voltages and the low driving voltages corresponding to the light transmittances of the respective gray scales are illustrated in a table of FIG. 9. Thus, the high driving voltage corresponding to the light transmittance of the TFT-LCD for a gray scale is the reference high driving voltage of the corresponding gray scale, and the low driving voltage corresponding to the light transmittance of the TFT-LCD for a gray scale is the reference low driving voltage of the corresponding gray scale.

Of course, those skilled in the art may utilize other suitable manners to determine the reference high driving voltage and the reference low driving voltage of the gray scale according to the relationship curve between the driving voltages of the source driving integrated circuit and the light transmittances of the TFT-LCD, and the Gamma curve of the TFT-LCD. The embodiment described herein is only a preferred implementation, and other implementations are omitted herein.

The process of setting the high driving voltage and the low driving voltage of the gray scale according to the average of the high driving voltage and the low driving voltage of the gray scale, and the increment of the reference high driving voltage and the reference low driving voltage of the gray scale with respect to the average of the reference high driving voltage and the reference low driving voltage of the gray scale at the step S402, may particularly comprise:

Setting the high driving voltage of the gray scale as VH=Vcenter+Vd, and setting the low driving voltage of the gray scale as VL=Vcenter−Vd, wherein Vd is the increment of the reference high driving voltage and the reference low driving voltage of the gray scale with respect to the average of the reference high driving voltage and the reference low driving voltage of the gray scale, and Vcenter is the average of the high driving voltage and the low driving voltage of the gray scale.

The average of the high driving voltage and the low driving voltage of the gray scale is determined according to the voltage jump of the pixel electrode in the TFT-LCD, and the increment of the reference high driving voltage and the reference low driving voltage of the gray scale with respect to the average of the reference high driving voltage and the reference low driving voltage of the gray scale is determined according to the relationship curve between the driving voltages of the source driving integrated circuit and the light transmittances of the TFT-LCD, and the Gamma curve of the TFT-LCD, therefore setting the high driving voltage as VH=Vcenter+Vd and setting the low driving voltage as VL=Vcenter−Vd may ensure a perfect display effect of the TFT-LCD, while the phenomenon of asymmetry in the driving voltages caused when the voltage jump of the pixel electrode in the TFT-LCD is different from the difference between the average of the high driving voltage and the low driving voltage and a reference voltage Vcom of the TFT-LCD is avoided and in turn the occurrence of the image sticking phenomenon may also be avoided.

Of course, those skilled in the art may utilize other suitable manners to set the high driving voltage and the low driving voltage of the gray scale according to the average of the high driving voltage and the low driving voltage, and the increment of the reference high driving voltage and the reference low driving voltage of the gray scale with respect to the average of the reference high driving voltage and the reference low driving voltage of the gray scale. The embodiment described herein is only a preferred implementation, and other implementations are omitted herein.

In an actual application, a relationship curve between the averages of the reference high driving voltages and the reference low driving voltages and the gray scales may be determined at first according to the relationship curve between the driving voltages of the source driving integrated circuit and the light transmittances of the TFT-LCD, and the Gamma curve of the TFT-LCD, and then it may be checked whether linear trends of the relationship curve between the averages of the reference high driving voltages and the reference low driving voltages and the gray scales and the relationship curve between the voltage jumps of the pixel electrode in the TFT-LCD and the gray scales are same. If yes, a probability of occurrence of the image sticking in the TFT-LCD is low, therefore the high driving voltage and the low driving voltage of the TFT-LCD may be set as the reference high driving voltage and the reference low driving voltage determined according to the relationship curve between the driving voltages of the source driving integrated circuit and the light transmittances of the TFT-LCD, and the Gamma curve of the TFT-LCD, respectively; otherwise, if no, the probability of occurrence of the image sticking in the TFT-LCD is high, then the steps S301 and S302 may be performed.

Figure 10:
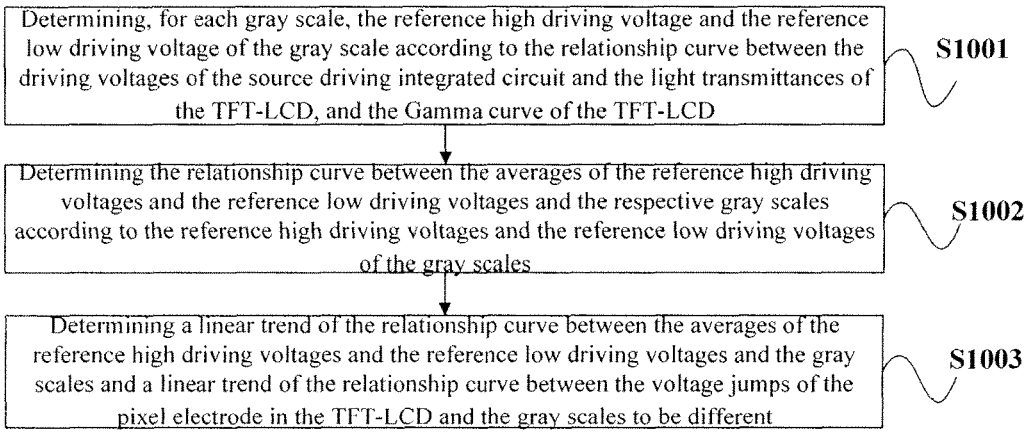
FIG. 10 is another flowchart illustrating a method for determining the driving voltages according to the embodiments of the present disclosure.

In particular, as illustrated in FIG. 10, before the step S301 is performed, the method for determining the driving voltages according to the embodiments of the present disclosure may further comprise steps as follows.

At a step S1001, for each gray scale, the reference high driving voltage and the reference low driving voltage of the gray scale are determined according to the relationship curve between the driving voltages of the source driving integrated circuit and the light transmittances of the TFT-LCD, and the Gamma curve of the TFT-LCD, the reference high driving voltage and the reference low driving voltage of the gray scale are a high driving voltage and a low driving voltage, which correspond to the light transmittance of the TFT-LCD corresponding to the gray scale, on the relationship curve between the driving voltages of the source driving integrated circuit and the light transmittances of the TFT-LCD, respectively.

At a step S1002, the relationship curve between the averages of the reference high driving voltages and the reference low driving voltages and the respective gray scales is determined according to the reference high driving voltages and the reference low driving voltages of the respective gray scales.

At a step S1003, the linear trend of the relationship curve between the averages of the reference high driving voltages and the reference low driving voltages and the gray scales and that of the relationship curve between the voltage jumps of the pixel electrode in the TFT-LCD and the gray scales are determined to be different.

In an example, the process of determining the reference high driving voltage and the reference low driving voltage of the gray scale according to the relationship curve between the driving voltages of the source driving integrated circuit and the light transmittances of the TFT-LCD, and the Gamma curve of the TFT-LCD, at the step S1001, may utilize the method for determining the reference high driving voltage and the reference low driving voltage illustrated in FIG. 7, and details are omitted herein.

The process of determining the linear trend of the relationship curve between the averages of the reference high driving voltages and the reference low driving voltages and the gray scales in the step S1003 may particularly comprise: determining the average of the reference high driving voltage and the reference low driving voltage corresponding to the lowest gray scale, and then determining the average of the reference high driving voltage and the reference low driving voltage corresponding to the highest gray scale, and in turn determining the linear trend of the relationship curve between the averages of the reference high driving voltages and the reference low driving voltages and the gray scales according to the determined two averages.

Figure 11:
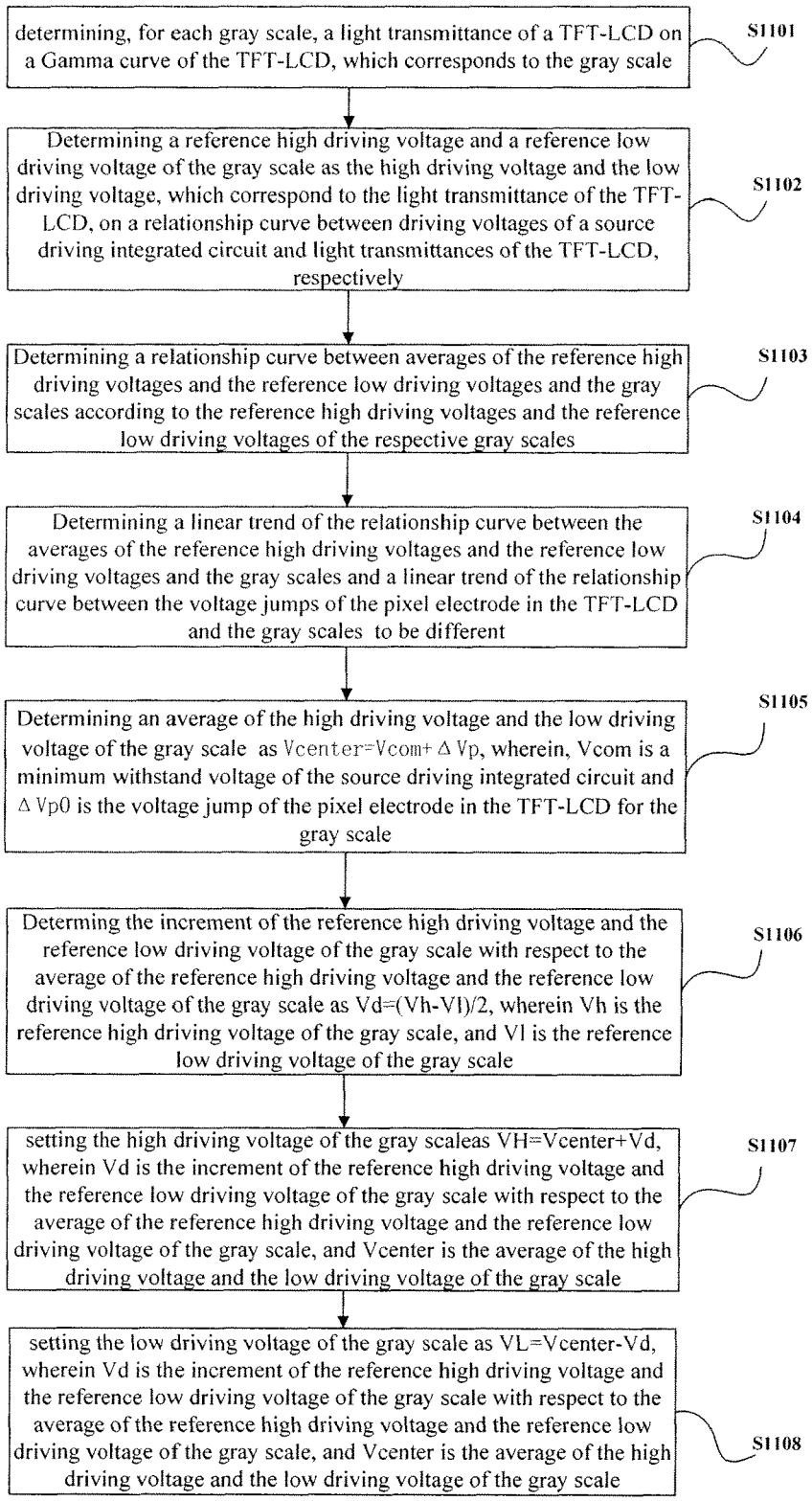
FIG. 11 is a flowchart illustrating a preferred method for determining the driving voltages according to the embodiments of the present disclosure.

In the embodiments of the present disclosure, there is further provided a preferred method for determining the driving voltages, as illustrated in FIG. 11, and the method may comprise steps as follows.

At a step S1101, for each gray scale, a light transmittance of a TFT-LCD on a Gamma curve of the TFT-LCD, which corresponds to the gray scale, is determined.

At a step S1102, a reference high driving voltage and a reference low driving voltage of the gray scale are determined as a high driving voltage and a low driving voltage, which correspond to the light transmittance of the TFT-LCD, on a relationship curve between driving voltages of a source driving integrated circuit and light transmittances of the TFT-LCD, respectively.

At a step S1103, a relationship curve between averages of the reference high driving voltages and the reference low driving voltages and the gray scales is determined according to the reference high driving voltages and the reference low driving voltages of the respective gray scales.

At a step S1104, a linear trend of the relationship curve between the averages of the reference high driving voltages and the reference low driving voltages and the gray scales and a linear trend of the relationship curve between the voltage jumps of the pixel electrode in the TFT-LCD and the gray scales are determined to be different.

At a step S1105, an average of the high driving voltage and the low driving voltage of the gray scale is determined as Vcenter=Vcom+ΔVp, wherein, ΔVp is the voltage jump of the pixel electrode in the TFT-LCD for the gray scale, and Vcom=V0/2−ΔVp0, wherein V0 is a sum of the high driving voltage and the low driving voltage, which correspond to the light transmittance of the TFT-LCD corresponding to a gray scale 0 on the Gamma curve of the TFT-LCD, in the relationship curve between the driving voltages of the source driving integrated circuit and the light transmittances of the TFT-LCD, and ΔVp0 is the voltage jump of the pixel electrode in the TFT-LCD corresponding to the gray scale 0.

At a step S1106, the increment of the reference high driving voltage and the reference low driving voltage of the gray scale with respect to the average of the reference high driving voltage and the reference low driving voltage of the gray scale is determined as Vd=(Vh−Vl)/2, wherein Vh is the reference high driving voltage of the gray scale, and Vl is the reference low driving voltage of the gray scale.

At a step S1107, a value of the high driving voltage of the gray scale is set as VH=Vcenter+Vd, wherein Vd is the increment of the reference high driving voltage and the reference low driving voltage of the gray scale with respect to the average of the reference high driving voltage and the reference low driving voltage of the gray scale, and the Vcenter is the average of the high driving voltage and the low driving voltage of the gray scale.

At a step S1108, a value of the low driving voltage of the gray scale is set as VL=Vcenter−Vd, wherein Vd is the increment of the reference high driving voltage and the reference low driving voltage of the gray scale with respect to the average of the reference high driving voltage and the reference low driving voltage of the gray scale, and the Vcenter is the average of the high driving voltage and the low driving voltage of the gray scale.

The average of the high driving voltage and the low driving voltage of the gray scale is determined as Vcenter=Vcom+ΔVp, so that the phenomenon of asymmetry in the driving voltages caused when the voltage jump of the pixel electrode in the TFT-LCD is different from the difference between the average of the high driving voltage and the low driving voltage and a reference voltage Vcom of the TFT-LCD may be avoided and in turn the occurrence of the image sticking phenomenon may also be avoided. The increment of the reference high driving voltage and the reference low driving voltage of the gray scale with respect to the average of the reference high driving voltage and the reference low driving voltage of the gray scale is determined according to the relationship curve between the driving voltages of the source driving integrated circuit and the light transmittances of the TFT-LCD, and the Gamma curve of the TFT-LCD, therefore setting the value of the high driving voltage as VH=Vcenter+Vd and setting the value of the low driving voltage as VL=Vcenter−Vd may further ensure a perfect display effect of the TFT-LCD.

Figure 12:
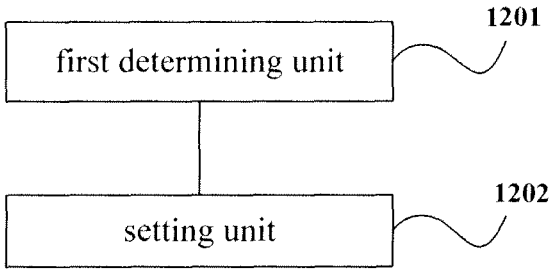
FIG. 12 is a schematic diagram illustrating an apparatus for determining the driving voltages according to the embodiments of the present disclosure.

FIG. 12 is a schematic diagram illustrating an apparatus for determining the driving voltages, which correspond to the method for determining the driving voltages shown in FIG. 3, according to the embodiments of the present disclosure, and the apparatus for determining the driving voltages may comprise:

a first determining unit 1201 for determining, for each gray scale, an average of a high driving voltage and a low driving voltage of the gray scale according to a voltage jump of a pixel electrode in a ITT-LCD for the gray scale; and a setting unit 1202 for setting the high driving voltage and the low driving voltage of the gray scale according to the average of the high driving voltage and the low driving voltage of the gray scale, a relationship curve between driving voltages of a source driving integrated circuit and light transmittances of the TFT-LCD, and a Gamma curve of the TFT-LCD.

The phenomenon of asymmetry in the driving voltages would occur when the voltage jump of the pixel electrode in the TFT-LCD is different from a difference between the average of the high driving voltage and the low driving voltage of the gray scale and a reference voltage Vcom of the TFT-LCD, therefore in the embodiments of the present disclosure, when the high driving voltage and the low driving voltage of the TFT-LCD are set for each gray scale, the average of the high driving voltage and the low driving voltage of the gray scale may be determined at first according to the voltage jump of the pixel electrode in the TFT-LCD for the gray scale, and then the high driving voltage and the low driving voltage of the gray scale may be set according to the determined average of the high driving voltage and the low driving voltage for the gray scale, the relationship curve between the driving voltages of the source driving integrated circuit and the light transmittances of the TFT-LCD, and the Gamma curve of the TFT-LCD. So that the phenomenon of asymmetry in the driving voltages caused when the voltage jump of the pixel electrode in the TFT-LCD is different from a difference between the average of the high driving voltage and the low driving voltage of the gray scale and the reference voltage Vcom of the TFT-LCD is avoided, and the image sticking is also avoided.

In an example, the particular process for the first determining unit 1201 determining the average of the high driving voltage and the low driving voltage of the gray scale according to the voltage jump of the pixel electrode in the TFT-LCD for the gray scale may particularly comprise:

determining the average of the high driving voltage and the low driving voltage of the gray scale as Vcenter=Vcom+ΔVp, wherein ΔVp is the voltage jump of the pixel electrode in the TFT-LCD for the gray scale, and Vcom=V0/2−ΔVp0, wherein V0 is a sum of the high driving voltage and the low driving voltage, which corresponds to the light transmittance of the TFT-LCD corresponding to a gray scale 0 on the Gamma curve of the TFT-LCD, in the relationship curve between the driving voltages of the source driving integrated circuit and the light transmittances of the TFT-LCD, and ΔVp0 is the voltage jump of the pixel electrode in the TFT-LCD corresponding to the gray scale 0.

In particular, the voltage jump ΔVp of the pixel electrode in the TFT-LCD for the gray scale may be determined by ΔVp=ΔVpmax−(1−i/n)Ω, wherein i is a gray scale level of the gray scale, n is a total number of the gray scales, ΔVpmax is a maximum value of $$\Delta Vp = \frac{C_{gd}(V_{on} - V_{off})}{C_{gd} + C_s + C_{lc}},$$

Ω is a difference between the maximum value and a minimum value of $$\Delta Vp = \frac{C_{gd}(V_{on} - V_{off})}{C_{gd} + C_s + C_{lc}},$$

$V_{on}$ is an ON voltage in the TFT-LCD, $V_{off}$ is an OFF voltage in the TFT-LCD, $C_{gd}$ is a parasitic capacitor between a drain and a gate in the TFT-LCD, $C_s$ is a pixel storage capacitor in the TFT-LCD, and $C_{lc}$ is a material equivalent capacitor in the TFT-LCD.

Taking a case where the total number of the gray scales is 63 as an example, the voltage jump of the pixel electrode in the TFT-LCD is ΔVp=ΔVpmax−(1−i/63)Ω. The maximum value of ΔVp is the maximum value of $$\Delta Vp = \frac{C_{gd}(V_{on} - V_{off})}{C_{gd} + C_s + C_{lc}},$$

and also is the ΔVp corresponding to the highest gray scale. The minimum value of the ΔVp is the minimum value of $$\Delta Vp = \frac{C_{gd}(V_{on} - V_{off})}{C_{gd} + C_s + C_{lc}},$$

and is also the ΔVp corresponding to the lowest gray scale. The maximum value and the minimum value of the $$\Delta Vp = \frac{C_{gd}(V_{on} - V_{off})}{C_{gd} + C_s + C_{lc}}$$

may be determined by adjusting capacitances. Next, a linear trend of the relationship curve between the voltage jumps of the pixel electrode in the TFT-LCD and the gray scales may be determined according to the ΔVp corresponding to the highest gray scale and the ΔVp corresponding to the lowest gray scale, as illustrated in FIG. 4. The voltage jumps of the pixel electrode in the TFT-LCD for the respective gray scales may be determined according to ΔVp=ΔVpmax−(1−i/n)Ω, for example: when i is 0, its voltage jump of the pixel electrode in the TFT-LCD may be determined according to ΔVp=ΔVpmin, wherein ΔVpmin is the minimum value of $$\Delta Vp = \frac{C_{gd}(V_{on} - V_{off})}{C_{gd} + C_s + C_{lc}};$$

when i is 1, its voltage jump of the pixel electrode in the TFT-LCD may be determined by ΔVp=ΔVpmax−0.984Ω; when i is 16, its voltage jump of the pixel electrode in the TFT-LCD may be determined by ΔVp=ΔVpmax−0.746Ω; when i is 32, its voltage jump of the pixel electrode in the TFT-LCD may be determined by ΔVp=ΔVpmax−0.492Ω: when i is 48, its voltage jump of the pixel electrode in the TFT-LCD may be determined by ΔVp=ΔVpmax−0.238Ω; when i is 62, its voltage jump of the pixel electrode in the TFT-LCD may be determined by ΔVp=ΔVpmax-0.016Ω; when i is 63, its voltage jump of the pixel electrode in the TFT-LCD may be determined by ΔVp=ΔVpmax.

The average of the high driving voltage and the low driving voltage of the gray scale is set as Vcenter=Vcom+ΔVp, therefore the voltage jump of the pixel electrode may be ensured effectively to be same as the difference between the average of the high driving voltage and the low driving voltage of the gray scale and the reference voltage Vcom of the TFT-LCD, so that the phenomenon of asymmetry in the driving voltages is avoided effectively, and in turn the occurrence of the image sticking are also avoided.

Of course, those skilled in the art may set the average of the high driving voltage and the low driving voltage of the gray scale with other suitable manners, the embodiment described herein is only a preferred implementation, and other implementations are omitted herein.

In an actual application, the particular process for the setting unit 1202 setting the high driving voltage and the low driving voltage of the gray scale according to the average of the high driving voltage and the low driving voltage of the gray scale, the relationship curve between driving voltages of a source driving integrated circuit and light transmittances of the TFT-LCD, and the Gamma curve of the TFT-LCD in S302 may include:

determining an increment of a reference high driving voltage and a reference low driving voltage of the gray scale with respect to an average of the reference high driving voltage and the reference low driving voltage according to the relationship curve between the driving voltages of the source driving integrated circuit and the light transmittances of the TFT-LCD, and the Gamma curve of the TFT-LCD, wherein the reference high driving voltage and the reference low driving voltage of the gray scale are a high driving voltage and a low driving voltage, which correspond to the light transmittance of the TFT-LCD corresponding to the gray scale, on the relationship curve between the driving voltages of the source driving integrated circuit and the light transmittances of the TFT-LCD, respectively; and setting the high driving voltage and the low driving voltage of the gray scale according to the average of the high driving voltage and the low driving voltage of the gray scale, and the increment of the reference high driving voltage and the reference low driving voltage of the gray scale with respect to the average of the reference high driving voltage and the reference low driving voltage of the gray scale.

The Gamma curve of the TFT-LCD may show the light transmittances corresponding to the respective gray scales when the TFT-LCD has a best display effect, therefore after the average of the high driving voltage and the low driving voltage are determined, the increment of the reference high driving voltage and the reference low driving voltage of the gray scale with respect to the average of the reference high driving voltage and the reference low driving voltage of the gray scale may be determined according to the relationship curve between the driving voltages of the source driving integrated circuit and the light transmittances of the TFT-LCD, and the Gamma curve of the TFT-LCD, and then the high driving voltage and the low driving voltage may be set according to the average of the high driving voltage and the low driving voltage of the gray scale, and the increment of the reference high driving voltage and the reference low driving voltage of the gray scale with respect to the average of the reference high driving voltage and the reference low driving voltage of the gray scale. Thus the display effect of the TFT-LCD is ensured while the occurrence of the image sticking is avoided.

Of course, those skilled in the art may utilize other suitable manners to set the high driving voltage and the low driving voltage of the gray scale according to the average of the high driving voltage and the low driving voltage of the gray scale, the relationship curve between the driving voltages of the source driving integrated circuit and the light transmittances of the TFT-LCD, and the Gamma curve of the TFT-LCD. The embodiment described herein is only a preferred implementation, and other implementations are omitted herein.

In an example, the particular process for the setting unit 1202 determining the increment of the reference high driving voltage and the reference low driving voltage of the gray scale with respect to the average of the reference high driving voltage and the reference low driving voltage of the gray scale according to the relationship curve between the driving voltages of the source driving integrated circuit and the light transmittances of the TFT-LCD and the Gamma curve of the TFT-LCD may comprise:

determining the reference high driving voltage and the reference low driving voltage of the gray scale according to the relationship curve between the driving voltages of the source driving integrated circuit and the light transmittances of the TFT-LCD, and the Gamma curve of the TFT-LCD; and determining the increment of the reference high driving voltage and the reference low driving voltage of the gray scale with respect to the average of the reference high driving voltage and the reference low driving voltage of the gray scale as $Vd=(Vh-Vl)/2$, wherein Vh is the reference high driving voltage of the gray scale, and Vl is the reference low driving voltage of the gray scale.

Of course, those skilled in the art may utilize other suitable manners to determine the increment of the reference high driving voltage and the reference low driving voltage of the gray scale with respect to the average of the reference high driving voltage and the reference low driving voltage of the gray scale according to the relationship curve between the driving voltages of the source driving integrated circuit and the light transmittances of the TFT-LCD, and the Gamma curve of the TFT-LCD. The embodiment described herein is only a preferred implementation, and other implementations are omitted herein.

In an example, the particular process for the setting unit 1202 determining the reference high driving voltage and the reference low driving voltage of the gray scale according to the relationship curve between the driving voltages of the source driving integrated circuit and the light transmittances of the TFT-LCD, and the Gamma curve of the TFT-LCD may comprise:

determining the light transmittance of the TFT-LCD corresponding to the gray scale in the Gamma curve of the TFT-LCD; and determining the reference high driving voltage and the reference low driving voltage of the gray scale as a high driving voltage and a low driving voltage, corresponding to the determined light transmittance of the TFT-LCD, on the relationship curve between the driving voltages of the source driving integrated circuit and the light transmittances of the TFT-LCD.

In an actual application, the light transmittances of the respective gray scales may be determined at first according to the Gamma curve of the TFT-LCD illustrated in FIG. 2, wherein the Gamma curve shown in FIG. 2 is a Gamma curve with a Gamma value of 2.2, the horizontal ordinates in the Gamma curve shown in FIG. 2 represent the gray scale levels, and the vertical ordinates represent the light transmittances of the TFT-LCD. In practice, the Gamma curve of FIG. 2 may be determined according to the Gamma value of the TFT-LCD, and the Gamma curve of FIG. 2 is a Gamma curve corresponding to the Gamma value of 2.2 when the Gamma value of the TFT-LCD is 2.2. The determined light transmittances of the TFT-LCD corresponding to the respective gray scales are illustrated in the table of FIG. 8, then the high driving voltages and the low driving voltages corresponding to the light transmittances of the TFT-LCD for the respective gray scales may be found in the relationship curve between the driving voltages of the source driving integrated circuit and the light transmittances of the TFT-LCD illustrated in FIG. 1. In the curve shown in FIG. 1, the horizontal ordinates represent the driving voltage of the source driving integrated circuit, and the vertical ordinates represent the light transmittances of the TFT-LCD, then the greater one of the two voltages corresponding to the light transmittance of a gray scale in the relationship curve between the driving voltages of the source driving integrated circuit and the light transmittances of the TFT-LCD is the high driving voltage of the gray scale, and the smaller one is the low driving voltage of the gray scale. The determined high driving voltages and the low driving voltages corresponding to the light transmittances of the respective gray scales are illustrated in the table of FIG. 9. Thus, the high driving voltage corresponding to the light transmittance of the TFT-LCD for a gray scale is the reference high driving voltage of the corresponding gray scale, and the low driving voltage corresponding to the light transmittance of the TFT-LCD for a gray scale is the reference low driving voltage of the corresponding gray scale.

Of course, those skilled in the art may utilize other suitable manners to determine the reference high driving voltage and the reference high driving voltage of the gray scale according to the relationship curve between the driving voltages of the source driving integrated circuit and the light transmittances of the TFT-LCD, and the Gamma curve of the TFT-LCD. The embodiment described herein is only a preferred implementation, and other implementations are omitted herein.

The particular process for the setting unit 1202 setting the high driving voltage and the low driving voltage of the gray scale according to the average of the high driving voltage and the low driving voltage of the gray scale, and the increment of the reference high driving voltage and the reference low driving voltage of the gray scale with respect to the average of the reference high driving voltage and the reference low driving voltage of the gray scale may comprise:

setting the high driving voltage of the gray scale as $VH=Vcenter+Vd$, and setting the low driving voltage of the gray scale as $VL=Vcenter-Vd$, wherein Vd is the increment of the reference high driving voltage and the reference low driving voltage of the gray scale with respect to the average of the reference high driving voltage and the reference low driving voltage of the gray scale, and the Vcenter is the average of the high driving voltage and the low driving voltage of the gray scale.

The average of the high driving voltage and the low driving voltage of the gray scale is determined according to the voltage jump of the pixel electrode in the TFT-LCD, and the increment of the reference high driving voltage and the reference low driving voltage of the gray scale with respect to the average of the reference high driving voltage and the reference low driving voltage of the gray scale is determined according to the relationship curve between the driving voltages of the source driving integrated circuit and the light transmittances of the TFT-LCD, and the Gamma curve of the TFT-LCD, therefore setting the high driving voltage as VH=Vcenter+Vd and setting the low driving voltage as VL=Vcenter−Vd may ensure a perfect display effect of the TFT-LCD, while the phenomenon of asymmetry in the driving voltages caused when the voltage jump of the pixel electrode in the TFT-LCD is different from the difference between the average of the high driving voltage and the low driving voltage and the reference voltage Vcom of the TFT-LCD may be avoided and in turn the occurrence of the image sticking phenomenon may be avoided.

Of course, those skilled in the art may utilize other suitable manners to set the high driving voltage and the low driving voltage of the gray scale according to the average of the high driving voltage and the low driving voltage, and the increment of the reference high driving voltage and the reference low driving voltage of the gray scale with respect to the average of the reference high driving voltage and the reference low driving voltage of the gray scale. The embodiment described herein is only a preferred implementation, and other implementations are omitted herein.

In an actual application, a relationship curve between the averages of the reference high driving voltages and the reference low driving voltages and the gray scales may be determined at first according to the relationship curve between the driving voltages of the source driving integrated circuit and the light transmittances of the TFT-LCD, and the Gamma curve of the TFT-LCD, and it may be checked whether the linear trend of the relationship curve between the averages of the reference high driving voltages and the reference low driving voltages and the gray scales and the linear trend of the relationship curve between the voltage jumps of the pixel electrode in the TFT-LCD and the gray scales are same. If yes, a probability of occurrence of the image sticking in the TFT-LCD is low, therefore the high driving voltage and the low driving voltage of the TFT-LCD may be set as the reference high driving voltage and the reference low driving voltage determined according to the relationship curve between the driving voltages of the source driving integrated circuit and the light transmittances of the TFT-LCD, and the Gamma curve of the TFT-LCD, respectively; otherwise, if no, the probability of occurrence of the image sticking in the TFT-LCD is high, then the driving voltages may be set by the first determining unit 1201 and the setting unit 1202.

Figure 13:
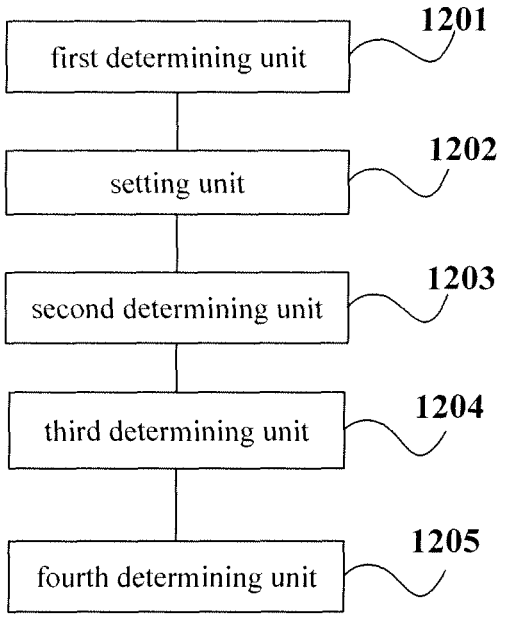
FIG. 13 is another schematic diagram illustrating an apparatus for determining the driving voltages according to the embodiments of the present disclosure.

In particular, as illustrated in FIG. 13, the apparatus for determining the driving voltages according to the embodiments of the present disclosure may further comprise:

a second determining unit 1203 for determining, for each gray scale, the reference high driving voltage and the reference low driving voltage of the gray scale according to the relationship curve between the driving voltages of the source driving integrated circuit and the light transmittances of the TFT-LCD, and the Gamma curve of the TFT-LCD, wherein the reference high driving voltage and the reference low driving voltage of the gray scale are a high driving voltage and a low driving voltage, which correspond to the light transmittance of the TFT-LCD corresponding to the gray scale, on the relationship curve between the driving voltages of the source driving integrated circuit and the light transmittances of the TFT-LCD, respectively;

a third determining unit 1204 for determining the relationship curve between the averages of the reference high driving voltages and the reference low driving voltages and the respective gray scales according to the reference high driving voltages and the reference low driving voltages of the respective gray scales;

a fourth determining unit 1205 for determining that the linear trend of the relationship curve between the averages of the reference high driving voltages and the reference low driving voltages and the gray scales and the linear trend the relationship curve between the voltage jumps of the pixel electrode in the TFT-LCD and the gray scales are different.

In an example, the particular process for the fourth determining unit 1205 determining the linear trend of the relationship curve between the averages of the reference high driving voltages and the reference low driving voltages and the gray scales may comprise: determining the average of the reference high driving voltage and the reference low driving voltage corresponding the lowest gray scale, and then determining the average of the reference high driving voltage and the reference low driving voltage corresponding to the highest gray scale, and in turn determining the linear trend of the relationship curve between the averages of the reference high driving voltages and the reference low driving voltages and the gray scales according to the determined two averages.

In the method and apparatus for determining driving voltages provided in the embodiments of the present disclosure, when the high driving voltage and the low driving voltage of the TFT-LCD are set, for each gray scale, the average of the high driving voltage and the low driving voltage of the gray scale is determined at first according to the voltage jump of the pixel electrode in the TFT-LCD for the gray scale, and then the high driving voltage and the low driving voltage of the gray scale are set according to the average of the high driving voltage and the low driving voltage for the gray scale, the relationship curve between driving voltages of the source driving integrated circuit and light transmittances of the TFT-LCD, and the Gamma curve of the TFT-LCD. Because the average of the high driving voltage and the low driving voltage are determined according to the voltage jump of the pixel electrode in the TFT-LCD, the phenomenon of asymmetry in the driving voltages caused when the voltage jump of the pixel electrode is different from the difference between the average of the high driving voltage and the low driving voltage and the reference voltage Vcom of the TFT-LCD would not occur, so that the image sticking problem due to a shift of the voltage jump of the pixel electrode in the TFT-LCD is avoided.

Those skilled in the art should understand that the embodiments of the present disclosure may be provided as a method, a system or a computer program product. Therefore, the present disclosure may utilize forms of complete hardware embodiments, complete software embodiments, or embodiments combining hardware and software. Moreover, the present disclosure may utilize a form of computer program products implemented on one or more computer usable storage media (including but not limited to a magnetic disc, CD-ROM, an optical memory, etc.) containing computer usable program codes.

The present disclosure is described by referring to flowchart and/or block diagram of the method, the device (system), and the computer program product according to the embodiments of the present disclosure. It should be understood that each process and/or block in the flowchart and/or the block diagram, and combinations of the processes and/or blocks in the flowchart and/or block diagram may be implemented by the computer program instructions. The computer program instructions may be provided to a general purpose computer, a dedicated purpose computer, an embedded processor or processors of other programmable data processing equipment to produce a machine, so that the instructions executed by the computers or the processors of other programmable data processing equipment may generate the apparatus for realizing the function(s) specified in the one or more processes in the flowcharts and/or one or more blocks in the block diagrams.

The computer program instructions may also be stored in a computer readable memory capable of booting the computer or other programmable data processing equipment to operate in a specific manner, so that the instructions stored on the computer readable memory may generate a product comprising an instruction apparatus, the instruction apparatus may realize the function(s) specified in the one or more processes in the flowcharts and/or one or more blocks in the block diagrams.

The computer program instructions may also be loaded into the computer or other programmable data processing equipment, which make the computer or other programmable data processing equipment perform a series of operation steps to generate processing implementable by the computer, so that the instructions executed on the computer or other programmable data processing equipment may provide steps for realizing the function(s) specified in the one or more processes in the flowcharts and/or one or more blocks in the block diagrams.

Although the preferred embodiments of the present disclosure have been described, those skilled in the art may make additional changes and modifications on these embodiments once they learn the basic inventive concept. Therefore the appended claims is intended to be explained as including the preferred embodiments and all changes and modifications falling into the scope of the present disclosure.

Obviously, those skilled in the art may make various changes and variations on the present disclosure without departing from the spirit and scope of the present disclosure. Thus, the present disclosure intends to cover the changes and variations to the present disclosure if such changes and variations belong to the scope defined by the claims of the present disclosure and equivalence thereof.

What is claimed is:

1. A method for determining driving voltages, comprising:

determining, for each gray scale, an average of a high driving voltage and a low driving voltage of the gray scale according to a voltage jump of a pixel electrode in a Thin Film Transistor-Liquid Crystal Display TFT-LCD for the gray scale, wherein said voltage jump of said pixel electrode is a difference of voltages at said pixel electrode before and after a voltage jump at said pixel electrode when a gate signal corresponding to said pixel electrode becomes off from on, wherein the voltage jump of said pixel electrode for each gray scale is determined dependent on a gray scale level of the gray scale, total number of the gray scales, a maximum value and a minimum value of the voltage jump of said pixel electrode; and setting the high driving voltage and the low driving voltage of the gray scale according to the average of the high driving voltage and the low driving voltage of the gray scale, a relationship curve between driving voltages of a source driving integrated circuit and light transmittances of the TFT-LCD, and a Gamma curve of the TFT-LCD, wherein said determining an average of a high driving voltage and a low driving voltage of the gray scale according to a voltage jump of a pixel electrode in a TFT-LCD for the gray scale comprises:

determining the average of the high driving voltage and the low driving voltage of the gray scale as $Vcenter=Vcom+\Delta Vp$, wherein $\Delta Vp$ is the voltage jump of the pixel electrode in the TFT-LCD for the gray scale, and $Vcom=V0/2-\Delta Vp0$, wherein V0 is a sum of the high driving voltage and the low driving voltage, which corresponds to the light transmittance of the TFT-LCD corresponding to a gray scale 0 in the Gamma curve of the TFT-LCD, in the relationship curve between the driving voltages of the source driving integrated circuit and the light transmittances of the TFT-LCD, and $\Delta Vp0$ is the voltage jump of the pixel electrode in the TFT-LCD corresponding to the gray scale 0, $\Delta Vp$ is determined by $\Delta Vp=\Delta Vpmax-(1-i/n)\Omega$, wherein i is the gray scale level of the gray scale, n is the total number of the gray scales, $\Delta Vpmax$ is the maximum value of $\Delta Vp$, $\Omega$ is a difference between the maximum value and the minimum value of $\Delta Vp$.

2. The method of claim 1, wherein, before determining, for each gray scale, an average of a high driving voltage and a low driving voltage of the gray scale according to a voltage jump of a pixel electrode in a TFT-LCD for the gray scale, the method further comprises:

determining, for each gray scale, a reference high driving voltage and a reference low driving voltage of the gray scale as the high driving voltage and the low driving voltage, which correspond to the light transmittance of the TFT-LCD corresponding to the gray scale, on the relationship curve between the driving voltages of the source driving integrated circuit and the light transmittances of the TFT-LCD, respectively, according to the relationship curve between the driving voltages of the source driving integrated circuit and the light transmittances of the TFT-LCD, and the Gamma curve of the TFT-LCD;

determining a relationship curve between averages of the reference high driving voltages and the reference low driving voltages and the respective gray scales according to the reference high driving voltages and the reference low driving voltages of the respective gray scales; and determining that a linear trend of the relationship curve between the averages of the reference high driving voltages and the reference low driving voltages and the respective gray scales and a linear trend of the relationship curve between the voltage jumps of the pixel electrode in the TFT-LCD and the respective gray scales are different.

3. The method of claim 2, wherein said determining the reference high driving voltage and the reference low driving voltage of the gray scale according to the relationship curve between the driving voltages of the source driving integrated circuit and the light transmittances of the TFT-LCD, and the Gamma curve of the TFT-LCD comprises:

determining the light transmittance of the TFT-LCD corresponding to the gray scale in the Gamma curve of the TFT-LCD; and determining the reference high driving voltage and the reference low driving voltage of the gray scale as the high driving voltage and the low driving voltage, corresponding to the determined light transmittance of the TFT-LCD, on the relationship curve between the driving voltages of the source driving integrated circuit and the light transmittances of the TFT-LCD.

4. The method of claim 1, wherein $$\Delta Vp = \frac{C_{gd}(V_{on} - V_{off})}{C_{gd} + C_s + C_{lc}},$$

$V_{on}$ is an ON voltage in the TFT-LCD, $V_{off}$ is an OFF voltage in the TFT-LCD, $C_{gd}$ is a parasitic capacitor between a drain and a gate in the TFT-LCD, $C_s$ is a pixel storage capacitor in the TFT-LCD, and $C_{lc}$ is a material equivalent capacitor in the TFT-LCD.

5. The method of claim 1, wherein said setting the high driving voltage and the low driving voltage of the gray scale according to the average of the high driving voltage and the low driving voltage of the gray scale, a relationship curve between driving voltages of a source driving integrated circuit and light transmittances of the TFT-LCD, and a Gamma curve of the TFT-LCD comprises:

determining an increment of a reference high driving voltage and a reference low driving voltage of the gray scale with respect to an average of the reference high driving voltage and the reference low driving voltage according to the relationship curve between the driving voltages of the source driving integrated circuit and the light transmittances of the TFT-LCD, and the Gamma curve of the TFT-LCD, wherein the reference high driving voltage and the reference low driving voltage of the gray scale are the high driving voltage and the low driving voltage, which correspond to the light transmittance of the TFT-LCD corresponding to the gray scale, on the relationship curve between the driving voltages of the source driving integrated circuit and the light transmittances of the TFT-LCD, respectively; and setting the high driving voltage and the low driving voltage of the gray scale according to the average of the high driving voltage and the low driving voltage of the gray scale, and the increment of the reference high driving voltage and the reference low driving voltage of the gray scale with respect to the average of the reference high driving voltage and the reference low driving voltage of the gray scale.

6. The method of claim 5, wherein said determining the increment of the reference high driving voltage and the reference low driving voltage of the gray scale with respect to the average of the reference high driving voltage and the reference low driving voltage of the gray scale according to the relationship curve between the driving voltages of the source driving integrated circuit and the light transmittances of the TFT-LCD and the Gamma curve of the TFT-LCD comprises:

determining the reference high driving voltage and the reference low driving voltage of the gray scale according to the relationship curve between the driving voltages of the source driving integrated circuit and the light transmittances of the TFT-LCD, and the Gamma curve of the TFT-LCD; and determining the increment of the reference high driving voltage and the reference low driving voltage of the gray scale with respect to the average of the reference high driving voltage and the reference low driving voltage of the gray scale as Vd=(Vh−Vl)/2, wherein Vh is the reference high driving voltage of the gray scale, and Vl is the reference low driving voltage of the gray scale.

7. The method of claim 6, wherein said determining the reference high driving voltage and the reference low driving voltage of the gray scale according to the relationship curve between the driving voltages of the source driving integrated circuit and the light transmittances of the TFT-LCD, and the Gamma curve of the TFT-LCD comprises:

determining the light transmittance of the TFT-LCD corresponding to the gray scale in the Gamma curve of the TFT-LCD; and determining the reference high driving voltage and the reference low driving voltage of the gray scale as the high driving voltage and the low driving voltage, corresponding to the determined light transmittance of the TFT-LCD, on the relationship curve between the driving voltages of the source driving integrated circuit and the light transmittances of the TFT-LCD.

8. The method of claim 5, wherein said setting the high driving voltage and the low driving voltage of the gray scale according to the average of the high driving voltage and the low driving voltage of the gray scale, and the increment of the reference high driving voltage and the reference low driving voltage of the gray scale with respect to the average of the reference high driving voltage and the reference low driving voltage of the gray scale comprises:

setting the high driving voltage of the gray scale as VH=Vcenter+Vd, and setting the low driving voltage of the gray scale as VL=Vcenter−Vd, wherein Vd is the increment of the reference high driving voltage and the reference low driving voltage of the gray scale with respect to the average of the reference high driving voltage and the reference low driving voltage of the gray scale, and Vcenter is the average of the high driving voltage and the low driving voltage of the gray scale.

9. An apparatus for determining driving voltages, comprising:

a first determining unit for determining, for each gray scale, an average of a high driving voltage and a low driving voltage of the gray scale according to a voltage jump of a pixel electrode in a TFT-LCD for the gray scale, wherein said voltage jump of said pixel electrode is a difference of voltages at said pixel electrode before and after a voltage jump at said pixel electrode when a gate signal corresponding to said pixel electrode becomes off from on, wherein the voltage jump of said pixel electrode for each gray scale is determined dependent on a gray scale level of the gray scale, total number of the gray scales, a maximum value and a minimum value of the voltage jump of said pixel electrode; and a setting unit for setting the high driving voltage and the low driving voltage of the gray scale according to the average of the high driving voltage and the low driving voltage of the gray scale, a relationship curve between driving voltages of a source driving integrated circuit and light transmittances of the TFT-LCD, and a Gamma curve of the TFT-LCD, wherein the first determining unit determines the average of the high driving voltage and the low driving voltage of the gray scale according to the voltage lump of the pixel electrode in the TFT-LCD for the gray scale comprises:

determining the average of the high driving voltage and the low driving voltage of the gray scale as Vcenter=Vcom+ΔVp, wherein ΔVp is the voltage jump of the pixel electrode in the TFT-LCD for the gray scale, and Vcom=V0/2−ΔVp0, wherein V0 is a sum of the high driving voltage and the low driving voltage, which corresponds to the light transmittance of the TFT-LCD corresponding to a gray scale 0 in the Gamma curve of the TFT-LCD, in the relationship curve between the driving voltages of the source driving integrated circuit and the light transmittances of the TFT-LCD, and ΔVp0 is the voltage jump of the pixel electrode in the TFT-LCD corresponding to the gray scale 0, ΔVp is determined by ΔVp=ΔVpmax−(1−i/n)Ω, wherein i is the gray scale level of the gray scale, n is the total number of the gray scales, ΔVpmax is the maximum value of ΔVp, Ω is a difference between the maximum value and the minimum value of ΔVp.

10. The apparatus of claim 9, further comprising:

a second determining unit for determining, for each gray scale, the reference high driving voltage and the reference low driving voltage of the gray scale as the high driving voltage and the low driving voltage, which correspond to the light transmittance of the TFT-LCD corresponding to the gray scale, on the relationship curve between the driving voltages of the source driving integrated circuit and the light transmittances of the TFT-LCD, respectively, according to the relationship curve between the driving voltages of the source driving integrated circuit and the light transmittances of the TFT-LCD, and the Gamma curve of the TFT-LCD;

a third determining unit for determining a relationship curve between averages of the reference high driving voltages and the reference low driving voltages and the respective gray scales according to the reference high driving voltages and the reference low driving voltages of the respective gray scales; and a fourth determining unit for determining that a linear trend of the relationship curve between the averages of the reference high driving voltages and the reference low driving voltages and the respective gray scales and a linear trend of the relationship curve between the voltage jumps of the pixel electrode in the TFT-LCD and the respective gray scales are different.

11. The apparatus of claim 10, wherein the setting unit determines the reference high driving voltage and the reference low driving voltage of the gray scale according to the relationship curve between the driving voltages of the source driving integrated circuit and the light transmittances of the TFT-LCD, and the Gamma curve of the TFT-LCD comprises:

determining the light transmittance of the TFT-LCD corresponding to the gray scale in the Gamma curve of the TFT-LCD; and determining the reference high driving voltage and the reference low driving voltage of the gray scale as the high driving voltage and the low driving voltage, corresponding to the determined light transmittance of the TFT-LCD, on the relationship curve between the driving voltages of the source driving integrated circuit and the light transmittances of the TFT-LCD.

12. The apparatus of claim 9, wherein $$\Delta Vp = \frac{C_{gd}(V_{on} - V_{off})}{C_{gd} + C_s + C_{lc}},$$

$V_{on}$ is an ON voltage in the TFT-LCD, $V_{off}$ is an OFF voltage in the TFT-LCD, $C_{gd}$ is a parasitic capacitor between a drain and a gate in the TFT-LCD, $C_s$ is a pixel storage capacitor in the TFT-LCD, and $C_{lc}$ s a material equivalent capacitor in the TFT-LCD.

13. The apparatus of claim 9, wherein the setting unit sets the high driving voltage and the low driving voltage of the gray scale according to the average of the high driving voltage and the low driving voltage of the gray scale, a relationship curve between driving voltages of a source driving integrated circuit and light transmittances of the TFT-LCD, and a Gamma curve of the TFT-LCD comprises:

determining an increment of a reference high driving voltage and a reference low driving voltage of the gray scale with respect to an average of the reference high driving voltage and the reference low driving voltage according to the relationship curve between the driving voltages of the source driving integrated circuit and the light transmittances of the TFT-LCD, and the Gamma curve of the TFT-LCD, wherein the reference high driving voltage and the reference low driving voltage of the gray scale are the high driving voltage and the low driving voltage, which correspond to the light transmittance of the TFT-LCD corresponding to the gray scale, on the relationship curve between the driving voltages of the source driving integrated circuit and the light transmittances of the TFT-LCD, respectively; and setting the high driving voltage and the low driving voltage of the gray scale according to the average of the high driving voltage and the low driving voltage of the gray scale, and the increment of the reference high driving voltage and the reference low driving voltage of the gray scale with respect to the average of the reference high driving voltage and the reference low driving voltage of the gray scale.

14. The apparatus of claim 13, wherein the setting unit determines the increment of the reference high driving voltage and the reference low driving voltage of the gray scale with respect to the average of the reference high driving voltage and the reference low driving voltage of the gray scale according to the relationship curve between the driving voltages of the source driving integrated circuit and the light transmittances of the TFT-LCD and the Gamma curve of the TFT-LCD comprises:

determining the reference high driving voltage and the reference low driving voltage of the gray scale according to the relationship curve between the driving voltages of the source driving integrated circuit and the light transmittances of the TFT-LCD, and the Gamma curve of the TFT-LCD; and determining the increment of the reference high driving voltage and the reference low driving voltage of the gray scale with respect to the average of the reference high driving voltage and the reference low driving voltage of the gray scale as Vd=(Vh-VI)/2, wherein Vh is the reference high driving voltage of the gray scale, and VI is the reference low driving voltage of the gray scale.

15. The apparatus of claim 14, wherein the setting unit determines the reference high driving voltage and the reference low driving voltage of the gray scale according to the relationship curve between the driving voltages of the source driving integrated circuit and the light transmittances of the TFT-LCD, and the Gamma curve of the TFT-LCD comprises:

determining the light transmittance of the TFT-LCD corresponding to the gray scale in the Gamma curve of the TFT-LCD; and determining the reference high driving voltage and the reference low driving voltage of the gray scale as the high driving voltage and the low driving voltage, corresponding to the determined light transmittance of the TFT-LCD, on the relationship curve between the driving voltages of the source driving integrated circuit and the light transmittances of the TFT-LCD.

16. The apparatus of claim 13, wherein the setting unit sets the high driving voltage and the low driving voltage of the gray scale according to the average of the high driving voltage and the low driving voltage of the gray scale, and the increment of the reference high driving voltage and the reference low driving voltage of the gray scale with respect to the average of the reference high driving voltage and the reference low driving voltage of the gray scale comprises:

setting the high driving voltage of the gray scale as VH=Vcenter+Vd, and sets the low driving voltage of the gray scale as VL=Vcenter-Vd, wherein Vd is the increment of the reference high driving voltage and the reference low driving voltage of the gray scale with respect to the average of the reference high driving voltage and the reference low driving voltage of the gray scale, and Vcenter is the average of the high driving voltage and the low driving voltage of the gray scale.

* * * * *